US008446279B2

(12) United States Patent
Jennings, III

(10) Patent No.: US 8,446,279 B2
(45) Date of Patent: May 21, 2013

(54) ARTICLE HOLDING AND TRACKING DEVICE

(76) Inventor: Bethew Bertrand Jennings, III, Pearland, TX (US)

( * ) Notice: Subject to any disclaimer, the term of this patent is extended or adjusted under 35 U.S.C. 154(b) by 36 days.

(21) Appl. No.: 12/818,162

(22) Filed: Jun. 18, 2010

(65) Prior Publication Data

US 2010/0328071 A1 Dec. 30, 2010

Related U.S. Application Data

(62) Division of application No. 11/714,558, filed on Mar. 6, 2007, now Pat. No. 7,755,483.

(60) Provisional application No. 60/864,086, filed on Nov. 2, 2006.

(51) Int. Cl.
*G08B 13/14* (2006.01)

(52) U.S. Cl.
USPC ..... 340/568.1; 340/568.8; 340/640; 340/541; 340/548; 340/665; 340/668; 340/572.1; 340/572.4; 242/379.2; 242/380; 242/381.6; 242/384.7; 242/385.4; 242/404.3

(58) Field of Classification Search
USPC ..... 340/568.1, 568.88, 640, 541, 548, 340/665, 668, 572.1, 572.4; 242/379.2, 380, 242/381.6, 384.7, 385.4, 404.3
See application file for complete search history.

(56) References Cited

U.S. PATENT DOCUMENTS

| | | | | |
|---|---|---|---|---|
| 5,938,137 | A * | 8/1999 | Poulson | 242/379.2 |
| 6,265,974 | B1 * | 7/2001 | D'Angelo et al. | 340/568.1 |
| 6,290,158 | B1 * | 9/2001 | Huang | 242/379 |
| 7,271,715 | B2 * | 9/2007 | Aupperle et al. | 340/539.13 |
| 7,446,664 | B2 * | 11/2008 | White | 340/573.1 |

* cited by examiner

*Primary Examiner* — Tai T Nguyen
(74) *Attorney, Agent, or Firm* — Jennings Law Group, PLLC; Bethew B. Jennings, III

(57) ABSTRACT

An apparatus is provided for holding articles, such as keys, which is attachable to a person's clothing, handbag or a purse, and wherein a physical or electronic tether is used to allow the user to use the articles stored thereupon without removing them from the holder or from their clothing, handbag, purse, briefcase or other hand carried item. The tension on the tether is manageable by the use of a tension management system, so that the tension of the tether will not damage the article or the mechanism that the article is used with and the article is tracked by use of the tether so that the user does not lose the article. Infrared, radio frequency, and transponder and polling versions of the invention are also disclosed.

20 Claims, 3 Drawing Sheets

ARTICLE HOLDING AND TRACKING DEVICE

CROSS REFERENCE TO RELATED APPLICATION

This non-provisional patent application claims priority and the benefit under 35 U.S.C. §119(e) of the U.S. Provisional Application Ser. No. 60/864,086, entitled "Article and Key Holder with Tethering Mechanism," filed Nov. 2, 2006, now issued as U.S. Pat. No. 7,755,483, entitled "Article Holding and Tracking Device all of which is herein incorporated by reference.

BACKGROUND OF THE INVENTION

1. Field of the Invention

This invention relates to a tethering mechanism with tension release for use with useful articles such as keys, tools and the like.

2. Description of Related Art

Many variations of key chains and key rings are known. Key chains and rings are supposed to provide an easy way of keeping track of one or more keys and further, provide a way of keeping these like objects together in one place. Indeed, key chains and key rings are commonplace in the market today. Additionally tethering systems and mechanisms have been developed to hold various articles at the end of a tether or lanyard, wherein the tether or lanyard is connected to an apparatus, which will automatically retract, rewind or adjust absent the user actively pulling or engaging the object at the end of the tether. By way of example, the NexxTech™ sliding key chain, purports to be a handy pocket keychain with a spring-loaded retractable cord and ring. Additionally, tools such as measuring tapes have found the need to incorporate catch and release functionality, wherein the spring loaded mechanism installed to rewind the tape can be engaged by pushing a button. By way of example, the Tape-A-Matic, which purports to be a handy tape measure, easily fits into a pocket or purse and features a 60" cloth tape with metric and inch scale, auto-lock, and push button retractable mechanism.

Further, modern day advances necessitate that chains, rings and lanyards, especially key chains, hold a variety of items. Small electronic devices, such as computer storage drives and access devices, such as remote car entry devices and remote car starters, and other usable articles such as cell phones, pagers, and the like, are conveniently kept along with keys on a key chain or on other chains, rings or lanyards. Convenience items, such as small tools, knives and flashlights are fashioned for key chains. Many membership or identification cards are fitted as small plastic tags with bar codes to be placed upon the key chain, such as health club memberships, grocery store savings cards, and motor club identification cards. Modern technology has designed payment devices to attach to key chains, such as small credit cards and wands that operate on radio frequencies to transmit information to make gasoline purchases. Further, many entry identification access cards have been adapted for use on lanyards or other chain type apparatuses. Devices have been created for people, especially people in the service industries such as janitors and house keepers, and construction workers, to wear chains, lanyards or some other tethering device on their person, such as on a belt or around the waist, and be able to engage the item easily, as necessarily. Further, men and/or women tend to attach chains and rings to purses, handbags, briefcases or other hand carried items, in an effort to keep up with critical items, such as keys. It is crucial that these valuable, information-holding and/or high-use items remain securely on the chain or lanyard and are not lost. It is likewise important that the user be able to use such devices on the chain, ring or lanyard without damaging the article used or the device the article is used in. As a result, there is a demand for a chain, ring and lanyard that can provide accessibility and safe usage of devices, such as keys, attached thereupon, while at the same time further helping the user to keep better track of the devices being used.

Lanyards for belts upon which one can attach various articles, such as keys, tools and other devices, are well known in the art. Please see U.S. Pat. No. 3,908,875 to Wilson, et al., U.S. Pat. No. 6,427,374 to Vaiani, U.S. Pat. No. 6,598,273 to Buettell. Further, other devices, such as U.S. Pat. No. 6,530,131 to Hopkins, and U.S. Pat. No. 6,216,319 to Elkins, have been adapted such that they can be worn on various parts of the body or even attached to other devices, such as a purse. However, tether feature of U.S. Pat. No. 4,245,486 to Matsumoto, et al. was not disclosed in any of the aforementioned patents.

U.S. Pat. No. 6,591,461 to Salentine, et al., discloses a connector attached to a cable or line used to relieve strain. While this patent is, indeed, drawn to a quick-release connector and seems to be concerned with the characteristic of disengaging whatever is connected to the tether before damage occurs from stress, it does not disclose the need for stress (tension) relief (release) when used as in the instant invention. U.S. Pat. No. 5,600,873 to May is drawn towards a tethered device disposed between the user and the ignition key of a watercraft so as to not lose the ignition key. U.S. Pat. No. 4,653,422 to Allen discloses a tether system for an automobile. Also, U.S. Pat. No. 6,650,240 to Lee, et al. discloses a method and apparatus for tracking articles during travel. As disclosed in this patent, when it is desired to check for the presence of the articles, processing means polls various registered articles to check for their presence and issues an alarm if an article is missing. Although all of these systems have some aspect of the instant invention, none of the prior art contemplates a tethered system as is the instant invention.

Also as a result of increased functionality of objects held on chains, rings and lanyards there is a demand for a versatile, compact and sophisticated key chain that provides easy and convenient access and usage of objects thereupon. Additionally, a device which incorporates the tethering system of the tape measure mentioned hereinabove with the key chain mentioned hereinabove is desirable.

It is with respect to these considerations and others that various embodiments of the present invention have been made.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Various embodiments utilizing the techniques described herein solve the above and other problems by providing an apparatus, system and method for holding various articles, such as keys, which is connected to a retractable tether and tension management mechanism or other tracking mechanism and which is attachable to clothing or other article kept on or near a person, such a belt or an handbag, briefcase or purse carried by a person, wherein said tension management mechanism manages the tension on the tether, so as to reduce, relieve or prevent tension on the article, such as keys, connected on the ring or chain when the article is in use. Alternatively, using another embodiment of this invention, tension is eliminated altogether by use of a radio frequency/polling mechanism.

Other apparatuses, systems and methods according to various embodiments will be or become apparent to one with skill in the art upon review of the following drawings and detailed description. It is intended that all such additional apparatuses, systems and methods be included within this description, be within the scope of the present invention, and be protected by the accompanying claims.

BRIEF DESCRIPTION OF THE DRAWINGS (PICTURES)

DETAILED DESCRIPTION

As briefly described above, embodiments are directed to providing an apparatus, system and method for holding various articles, such as keys, which is connected to a retractable tether and tension management mechanism and which is attachable to clothing or other article kept on or near a person, such a belt or an handbag or purse carried by a person, wherein said tension management mechanism manages the tension on the tether, so as to reduce, relieve or prevent tension on the article, such as keys, connected on the ring or chain when the article is in use. In the following detailed description, references are made to the accompanying drawings that form a part hereof, and in which are shown by way of illustrations specific embodiments or examples. These embodiments may be combined, other embodiments may be utilized, and structural changes may be made without departing from the spirit or scope of the present invention. The following detailed description is therefore not to be taken in a limiting sense, and the scope of the present invention is defined by the appended claims and their equivalents.

Figure 1:
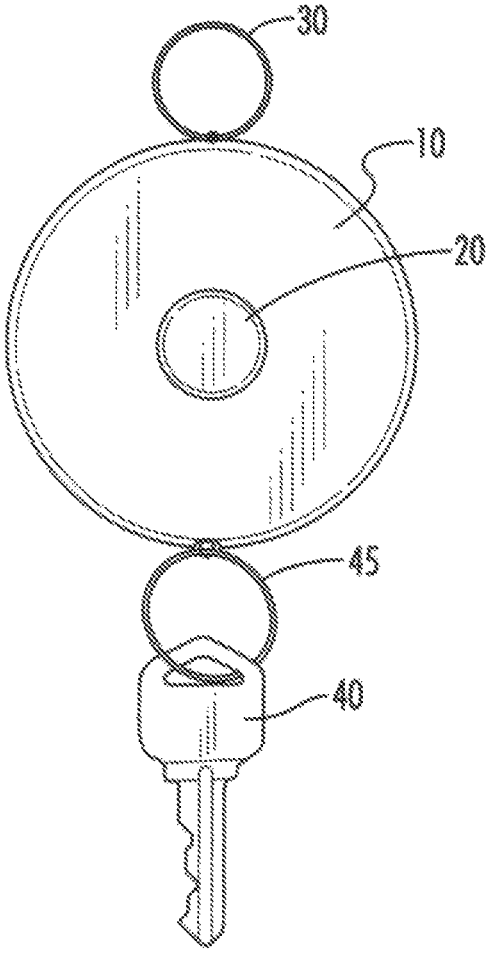
FIG. 1 is a depiction of the article holding and tracking device with the tether completely retracted and an article (key) attached.

Turning now to FIG. 1, which shows an embodiment, an article holding and tracking lanyard mechanism 10 is provided for holding and tracking an article 40, such as key(s). This mechanism 10 may be made of any material sufficient for heavy usage, including metal or plastic. An actuator 20, such as a button, exists somewhere on the mechanism 10, and is used to engage the tension on the tether 50 (shown in FIG. 3). The mechanism 10 also comprises a mechanism attaching means 30, which is used to attach the mechanism 10 to clothing or other article as desired by the user. It should be understood by those of ordinary skill in the art that the mechanism 10 and its many parts may be arranged or designed in various shapes, sizes, and in various ways so as to make the mechanism 10 esthetically pleasing to the user. One of ordinary skill in the art will also appreciate that any of a number of articles can be used with this article holding and tracking device, including flash drives, access cards for card readers, flashlights, tool sets such as wrenches and screw drivers, self-defense articles, cell phones and pagers, and the like.

Figure 2:
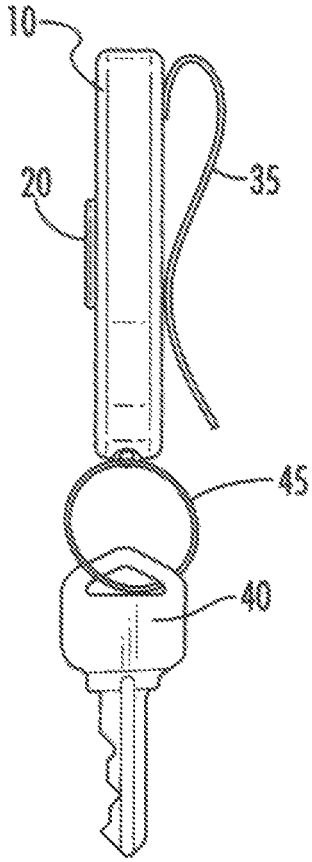
FIG. 2 is a side view of the article holding and tracking device with the tether completely retracted and an article attached and wherein a clip for mechanism attachment is shown.

Now turning to FIG. 2, the mechanism 10 is shown from a side view to show another embodiment of a mechanism attaching means 35, such as a belt clip versus a ring (as shown in FIG. 1, item 30), which may be used so that mechanism 10 may be easily affixed to the user's clothing. The user may or may not desire the aforementioned mechanism attaching means 30 (not shown in FIG. 2) when using mechanism attaching means 35. It will be appreciated by one of ordinary skill in the art that although the mechanism attaching means 30 and 35 are disclosed in the drawings, a wide variety of clips, snap rings and measurements of the same are possible and are intended to be within the spirit of this invention. Additionally, article attaching means 45 is meant to include the capability of allowing the user to easily detach the article and re-attach the article 40, as necessary.

Figure 3:
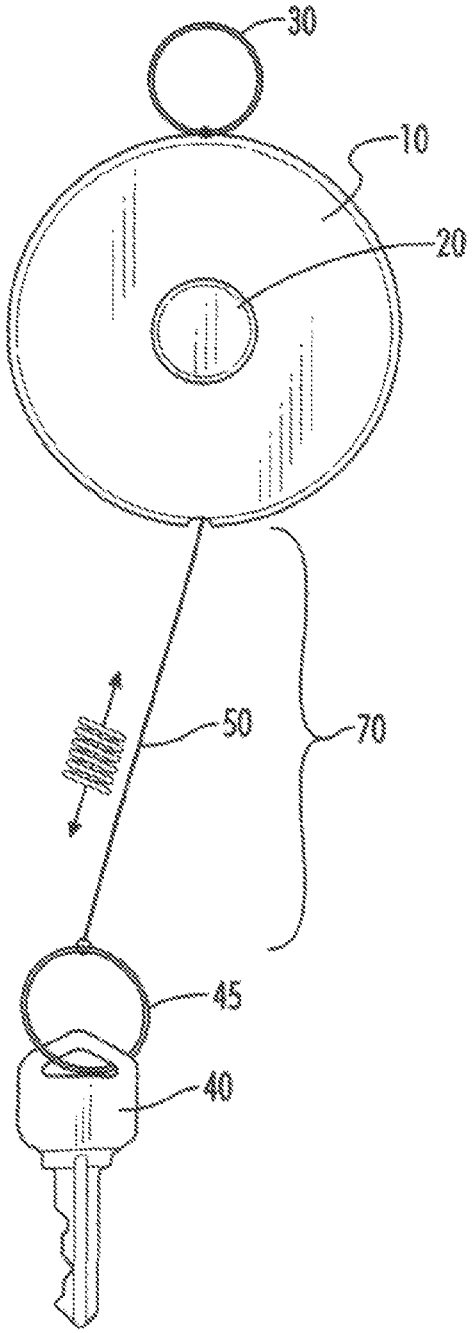
FIG. 3 is a depiction of the article holding and tracking device, wherein an article has been protracted and tension exists on the tether.

Now turning to FIG. 3, the mechanism 10 is shown with the article 40 protracted and connected to the tether 50, which is under tension from the mechanism 10. The tether 50 should be made of a sufficiently strong material able to withstand repeated protraction and retraction. It will be appreciated by those of ordinary skill in the art that tether 50 can be made out of a variety of materials and can be of varying protraction length 70, for instance, thirty six (36) inches long. The tether 50 is protracted under continuous tension to a desired length 70.

One of ordinary skill in the art will appreciate that many different catch and release mechanisms will work with the instant invention. The mechanism of the common window shade is an example of a catch and release that will work with the instant invention. There, tension is applied to the shade until the user lowers it to a specific level. Once the level is reached, tension on the shade is disengaged. To re-engage the tension on the shade for the purposes of raising it, the user lowers the shade a certain length and releases and allows the tension of the shade mechanism to rewind the shade, thereby raising it. This shade operation may easily be applied to this invention.

Figure 4:
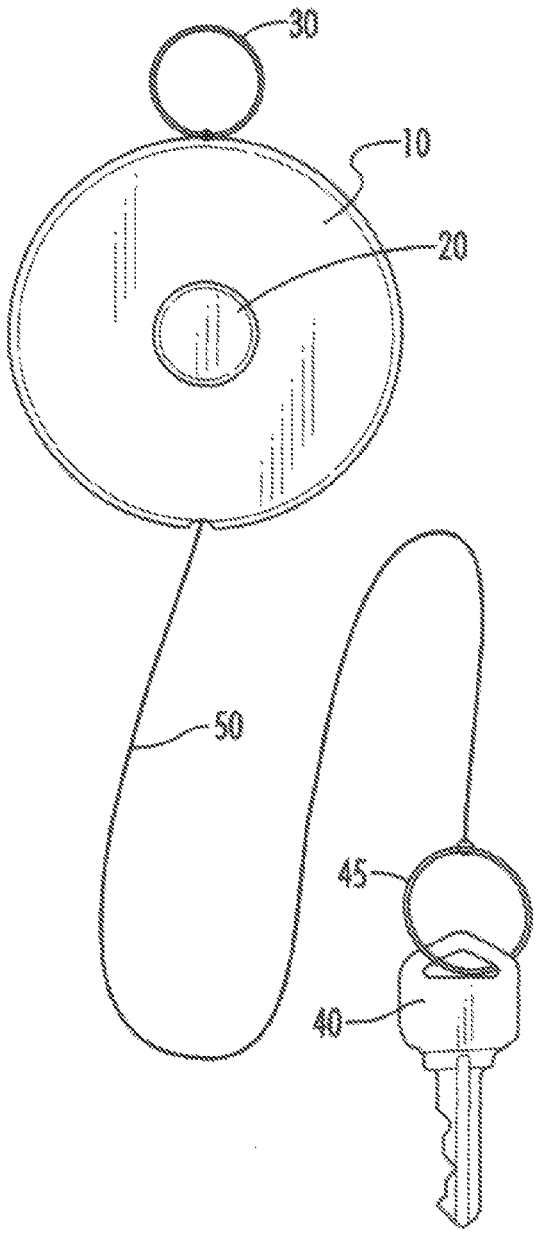
FIG. 4 is a depiction of the article holding and tracking device, wherein an article has been fully protracted and tension is disengaged and/or released on the tether.

Turning now to FIG. 4, the mechanism 10 is shown with the article 40 protracted and connected to the tether 50, which is not under tension from the mechanism 10. Continuing from the description of FIG. 3, once that length 70 is reached, a catch mechanism inside the mechanism 10 is engaged either by the user through use of actuator 20, or automatically as may be preset by the user, thereby relieving the tension on the tether 50 at the site of the article 40. The user may then use the article 40 without fear of the tension damaging the article 40 or the apparatus (not shown) on which the article 40 is used. Once the user is finished using the article 40, the user may depress or engage the actuator 20 to re-engage the tension on the tether 50, thereby allowing for the tether 50 to be retracted back to the mechanism 10.

Figure 5:
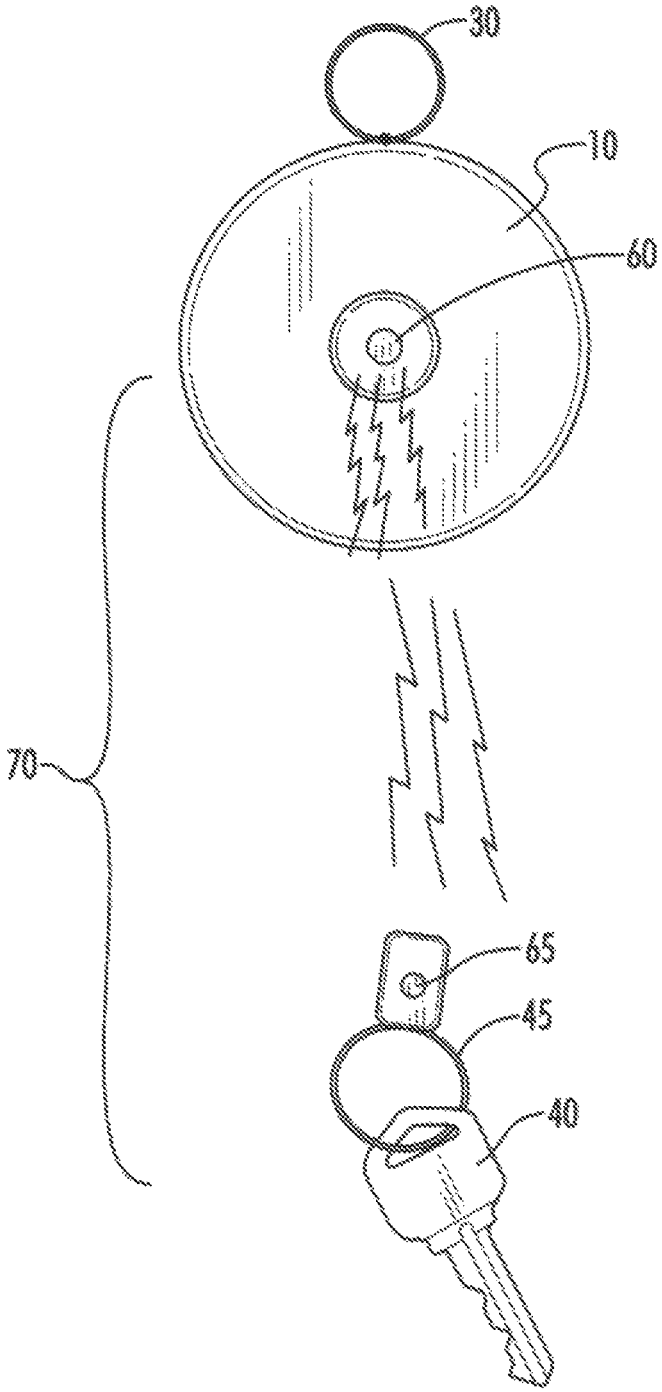
FIG. 5 is a depiction of the article holding and tracking device, wherein a communication system between the article holding and tracking device and the article is used without need for a tether.

Finally turning to FIG. 5, the mechanism 10 is shown using communication system means wherein the tethering is accomplished by electronic means, such as infrared (IR), radio frequency (RF), a transmitter/receiver or transponder/polling means or other communication system. This is accomplished by two communicators, one communicator 60 affixed on the mechanism 10, and another communicator 65 attached to the article 40. In this embodiment, communicator 60 is in communication with communicator 65 either constantly, or at specific time intervals. When length/distance 70 becomes outside of a preset range or special constraint, then the user of mechanism 10 will be alerted by sound or vibration that the communicator 65 and thus the article is outside of the preset distance constraints. This will alert and remind the user to retrieve the article and not to forget it, which may result in loss of the article.

In all instances, the lengths and circumferences may be varied in the invention so as to accommodate usage parameters, environmental variances and comfort of the user of the device.

Based on the foregoing, it should be appreciated that various embodiments, among others, are directed to providing an article holding and tracking device. It will be apparent by those skilled in the art that various modifications or variations may be made in the present invention without departing from the scope or spirit of the invention. Other embodiments of the present invention will be apparent to those skilled in the art from consideration of the specification and practice of the invention disclosed herein.

I claim:

1. An article tracking apparatus, comprising:

an electronic lanyard, said electronic lanyard including a connector configured to attach to a user;

an article connector, said article connector connecting to at least one article; and an electronic tether, said electronic tether further comprising a first communicator attached to said electronic lanyard and a second communicator attached to said article connector;

an alarm connected to said first communicator to notify the user of a status of the electronic tether; and wherein said first and second communicators communicate in tracking a distance between said user and said at least one article.

2. The apparatus of claim 1, wherein said alarm notifies user when the distance between the communicators is beyond a spatial constraint.

3. The apparatus of claim 2, wherein said spatial constraint is set by said user.

4. The apparatus of claim 2, further comprising a timer, wherein once the communicators are outside of spatial constraints for a certain period of time, the user is notified.

5. The apparatus of claim 2, wherein the alarm notifies user by an alert selected from a group consisting of a sound, a light, and a vibration.

6. The apparatus of claim 5, wherein said sound is selected from a group consisting of a recorded voice, recorded music, synthesized voice and synthesized music.

7. The apparatus of claim 1, wherein said communication is accomplished through means of a transponder and polling means.

8. The apparatus of claim 1, wherein said article connector is a holder.

9. The apparatus of claim 8, wherein said holder is a decorative protector of said article.

10. The apparatus of claim 1, wherein said status is checked continually.

11. The apparatus of claim 1, wherein said status is checked continuously.

12. The apparatus of claim 1, wherein said communication is accomplished wirelessly.

13. The apparatus of claim 1, wherein said first and second communicators track a distance between said at least one article and said user and communicates said distance to said user.

14. The apparatus of claim 13, wherein said alert notifies faster as said distance increases.

15. The apparatus of claim 13, wherein said alert notifies user slower as said distance increases.

16. The apparatus of claim 13, wherein said alert notifies user faster as said distance decreases.

17. The apparatus of claim 13, wherein said alert notifies user slower as said distance decreases.

18. The apparatus of claim 1, wherein said first and second communicators track a direction of said at least one article from said user and communicates said direction to said user.

19. The apparatus of claim 1, wherein said connector attaches to said user said connector selected from a group consisting of a magnetic fastener, a hooks-and-loops fastener, and a zipper fastener.

20. The apparatus of claim 1, wherein said article connector connects to said at least one article, said article connector selected from a group consisting of a magnetic fastener, a hooks-and-loops fastener, and a zipper fastener.

* * * * *